US006551769B2

(12) United States Patent
Viaene et al.

(10) Patent No.: US 6,551,769 B2
(45) Date of Patent: Apr. 22, 2003

(54) SILVER HALIDE PHOTOGRAPHIC MATERIAL COMPRISING A PERMANENT CONDUCTIVE SUBBING LAYER AND A SCRATCH-RESISTANT BACKING LAYER

(75) Inventors: Kris Viaene, Bonheiden (BE); Etienne Van Thillo, Essen (BE); Hartwig Andries, Rupelmonde (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/968,292

(22) Filed: Oct. 1, 2001

(65) Prior Publication Data

US 2002/0123013 A1 Sep. 5, 2002

Related U.S. Application Data

(60) Provisional application No. 60/243,475, filed on Oct. 27, 2000.

(30) Foreign Application Priority Data

Oct. 5, 2000 (EP) ..... 00203479

(51) Int. Cl.[7] ..... G03C 1/795; G03C 1/83; G03C 1/825; G03C 1/85; G03C 1/91

(52) U.S. Cl. ..... 430/522; 430/510; 430/517; 430/527; 430/529; 430/530; 430/961

(58) Field of Search ..... 430/510, 517, 430/522, 527, 529, 530, 961

(56) References Cited

U.S. PATENT DOCUMENTS

| | | | | |
|---|---|---|---|---|
| 6,124,083 | A | 9/2000 | Majumdar et al. | 430/529 |
| 6,248,510 | B1 * | 6/2001 | Anderson et al. | 430/527 |

FOREIGN PATENT DOCUMENTS

| | | |
|---|---|---|
| EP | 0 252 550 A1 | 1/1988 |
| EP | 0 772 080 A2 | 5/1997 |
| EP | 0 862 085 A1 | 9/1998 |

OTHER PUBLICATIONS

Research Disclosure, Jun. 1992, Item 33840, Messena et al.
European Search Report, Application No. EP 00 20 3479 (Apr. 27, 2001).

* cited by examiner

*Primary Examiner*—Richard L. Schilling
(74) *Attorney, Agent, or Firm*—Joseph T. Guy; Nexsen Pruet Jacobs & Pollard, LLC

(57) ABSTRACT

A silver halide photographic film element has been disclosed, said element comprising on a light-sensitive side of a transparent polyester support, and, in order, an electrically conductive subbing layer, an antihalation undercoat, a light-sensitive emulsion layer or multilayer arrangement, optionally including one or more intermediate, non-light-sensitive layers between emulsion layers in said multilayer arrangement, and a protective overcoat; and on a backing layer side opposite thereto, in order, a subbing layer containing a lubricant and a topcoat layer, characterized in that on the light-sensitive side of said element said subbing layer comprises an antistatic agent providing a substantially unchanged electrical resistivity of the said element before and after processing of said material, and said antihalation undercoat optionally comprises a high temperature boiling solvent; whereas on the backing layer side a friction coefficient of the backing layer versus stainless steel remains unchanged in the range between 0.20 and 0.30 before and after processing of said material, even after removal of the said topcoat layer during processing in an alkaline developer.

10 Claims, No Drawings

SILVER HALIDE PHOTOGRAPHIC MATERIAL COMPRISING A PERMANENT CONDUCTIVE SUBBING LAYER AND A SCRATCH-RESISTANT BACKING LAYER

This application claims benefit of U.S. Provisional Application No. 60/243,475 filed Oct. 27, 2000

FIELD OF THE INVENTION

The present invention relates to a photographic film material comprising on one side of a support material, a conductive subbing layer providing permanent antistatic properties and on the opposite side of the support, a backing layer providing suitable scratch resistance.

More specifically the said photographic film is especially suitable for use as a motion picture color print film.

BACKGROUND OF THE INVENTION

Silver halide photographic motion picture used as print films for movie theater projections have since quite a long period of time made use of a layer containing "carbon black" on the side opposite to the light-sensitive side of the film. This backing layer thereby provides both antihalation protection and antistatic properties.

"Carbon black", is applied in a alkali-soluble binder thus allowing the layer to be removed by a processing step involving soaking of the film material in an aqueous alkaline solution, followed by scrubbing the backside layer and rinsing with water. This "carbon black removal" takes place prior to image development and is both tedious and environmentally undesirable since large quantities of water are utilized. Moreover in order to facilitate removal during film processing, the backing layer containing carbon black is not made highly adherent to the photographic film support and may dislodge during various film manufacturing operations or manipulations, such as during film slitting and film perforation. Carbon black debris generated during these operations may become lodged on the photographic emulsion and may cause image defects during subsequent exposure and film processing.

After removal of carbon black the antistatic properties of the processed film material are lost. Undesired static charge build-up may thus occur on the motion picture print film when transported through projectors or on rewinding equipment. Although these high static charges cannot cause static marks on the processed photo-graphic element or material when discharging, the said high static charges may attract dirt particles to the film surface. Once deposited on the film surface, these dirt particles may create abrasion or scratches or, if sufficiently large, dirt particles may become visible and disturb the projected image, which may become very ennoying to the spectators. Conventional backing layers containing carbon-black are typically containing a lubricant therein or in an overcoat layer in order to improve conveyance during manufacturing operations or image exposure. After processing however the lubricant is removed together with the carbon black and, therefore, processed film has a high friction coefficient, measured on the side of the backing layers of the film, which is undesirable for good transport and film durability during repeated cycles through a movie theater projector.

Use in motion picture films of coatings having a layer containing carbon black on the side of the support opposite to the light-sensitive layers (therefore als called "backing layer") has been described e.g. in U.S. Pat. Nos. 2,271,234 and 2,327,828.

An alternative for a backing layer containing carbon black has been proposed e.g. in EP-A 0 772 080 and the corresponding U.S. Pat. No. 5,679,505. Therein a photographic film has been described comprising a support having, in order, on one side thereof an antihalation undercoat and at least one silver halide emulsion layer and having on the opposite side thereof a permanent antistatic layer and a protective topcoat, wherein the protective topcoat is comprised of a polyurethane binder and a lubricant. However a disadvantage of such a polyurethane binder is the appearance of "tar adsorption" during processing. Therefore in several patent applications a topcoat has been described which is situated on top of the backing layer comprising the polyurethane binder in order to minimize the said "tar adsorption" (see e.g. U.S. Pat. Nos. 5,786,134; 5,910,399; 5,952,165; 5,962,207 and 5,928,848).

Another alternative has been proposed e.g. in EP-A 0 252 550 wherein a photographic film has been described comprising a transparent support having coated thereon, in succesion a blue-sensitive silver halide emulsion layer, a red-sensitive emulsion layer, an intermediate layer, a green-sensitive layer and an antistress layer wherein between the said support and the blue-sensitive silver halide emulsion layer a yellow antihalation undercoat has been provided which comprises at least one yellow non-diffusing dye absorbing blue light, wherein said dye is removable and/or decolorizable during processing, as well as between the blue-sensitive layer and the red-sensitive layer, where an bluish antihalation layer is present as an intermediate layer, said layer comprising at least one non-diffusing blue dye absorbing red light which is removable and/or decolorizable during processing.

The other side of the support has been provided with an antistatic layer comprising an electroconductive polymer such as polystyrene sulphonic acid sodium salt. A disadvantage of such a backing layer however is the poor abrasion resistance and durability for motion picture print film applications. In addition antistatic performance of these polymers is greatly reduced after processing.

As is well known subtitling may, in several countries wherein the mother tongue is differing from a world language, be an additional requirement. Such a subtitling of a processed motion picture print film can be performed by means of a laser beam of high energy. An optimized method of subtitling a motion picture film has been described e.g. in U.S. Pat. No. 5,367,348. As has been disclosed in said Application the method is well adapted to subtitle motion picture films on a support based on cellulose derivatives such as cellulose triacetate, but is equally applicable to film supports based on a thermoplastic polymer material such as polyester. However if use is made of a transparent polyester support such as e.g. polyethylene terephthalate, disturbing optical failures may occur.

As has been described in EP-A 0 782 045 addition of at least one light-stabilizer and at least one reducing agent in the antihalation undercoat provides better subtitling quality when performed by means of a laser beam on a motion picture print film coated on polyester.

A remaining disadvantage of that invention however is the fact that addition of these compounds to the antihalation undercoat, also comprising the antihalation dyes, makes the amount and load of organic substances in the antihalation layer become very large. As the weight ratio of organic substances to gelatin should be reduced in order to avoid physical disadvantages the required amount of gelatin coated in the antihalation undercoat becomes too large.

OBJECTS OF THE INVENTION

It is an object of the present invention to provide a photographic film material useful as a motion picture print film, without utilizing a backing layer containing "carbon black", which does not show, after processing, the aforesaid problems of loss of conductivity and loss of durability, especially with respect to scratching stability.

It is a further object to provide a motion picture print film which can be subtitled by means of a laser and which provides high quality—good definition—of the figures, burned through the whole layer package of the color print material.

Further objects of the present invention will become apparent from the description hereinafter.

SUMMARY OF THE INVENTION

The above mentioned objects have been realized by providing a silver halide photographic film element comprising, on a light-sensitive side of a transparent polyester support, in order, an electrically conductive subbing layer, an antihalation undercoat, a light-sensitive emulsion layer or layer arrangement (optionally including one or more intermediate, non-light-sensitive layers between said emulsion layers) and a protective overcoat; and on a non-light-sensitive backing layer at the side opposite thereto, in order, a subbing layer containing a lubricant and a topcoat layer, characterized in that on the light-sensitive side of the support said subbing layer, comprises an antistatic agent providing a substantially unchanged electrical resistivity (conductivity) of the said element before and after processing it, and said antihalation undercoat optionally comprises a high temperature boiling solvent, and in fact comprises said high temperature boiling solvent when used in an element suitable for subtitling purposes as a color print material; whereas on the backing layer side a friction coefficient of the backing layer versus stainless steel remains unchanged in the range between 0.20 and 0.30 before and after processing of said material (even after removal of the said topcoat layer during processing in an alkaline developer).

The conductive subbing layer coated at the light-sensitive side of the transparent polyester support shows about unchanged antistatic properties due to the presence of an electronically conductive compound providing, before and after processing, where the electrical resistivity of this subbing layer is situated between $1\times10^5$ and $1\times10^{12}$ Ω/□, more preferably between $1\times10^7$ and $1\times10^{10}$ Ω/□, resulting in an unchanged electrical resistivity of the emulsion side of the element or material between $1\times10^9$ and $1\times10^{14}$ Ω/□ and more preferably between $1\times10^9$ and $1\times10^{11}$ Ω/□. The expression "substantially unchanged" indicates that changes in electrical resistivity are limited, in that differences before and after processing are less than a factor of 100 ($10^2$) Ω/□, and more preferably less than a factor 10 ($10^1$) Ω/□.

Thanks to the presence of a lubricant in the subbing layer at the side of the backing layer opposite to the light-sensitive side of the polyester support and to the removal during processing of the topcoat layer only, on the said backing layer side, the friction coefficient of the backing layer versus stainless steel remains about unchanged in the range between 0.20 and 0.30, which is an indispensble asset in order to avoid problems during manufacturing, i.a. during processing of the exposed film material as well as during projection of the processed material) of the film, more particularly with respect to scratchability.

Otherwise presence of a high temperature boiling solvent, preferably in an amount of from 0.1 to 0.5 g/m$^2$, in the antihalation undercoat at the light-sensitive side of the polyester support, and, optionally, in an amount of from 0.2 to 1.0 g/m$^2$ in the blue-sensitive emulsion layer of a color print material, provides an optimized laser subtitling quality, whereas presence of permanent antistatic agent(s) in the subbing layer avoids charging of the layers and dust attraction, both measures avoiding optically disturbing effects.

Further advantages and embodiments of the present invention will become apparent from the following description.

DETAILED DESCRIPTION OF THE INVENTION

Opposite to "non-permanent antistatic properties" (reflecting differences measured before and after processing for the lateral electrical resistivity of the element or material under investigation) "permanent antistatic properties" have been attained for materials by provision of "electronic conductivity", thereby reducing the said "lateral electrical resistance" to a value of about e.g. $10^6$ Ω/□. Such a relatively low resistance has been obtained, particularly in the presence of electronically conducting polymers as e.g. polyethylene dioxythiophene, described in EP-A's 0 253 594,0 292 905, 0 339 340, 0 348 961, 0 440 957, 0 505 955, 0 530 849,0 553 502, 0 554 588, 0 564 911, 0 570 795, 0 593 111, 0 602 713 and 0 628 560, and in U.S. Pat. Nos. 5,279,768; 5,213,714 and 5,306,443.

In most cases the thiophene compounds are comprised in one or more subbing layers of the materials. By reducing the lateral electrical resistance of the light-sensitive silver halide photographic material the positive or negative charges generated after e.g. friction with another material (e.g. inlet in a processing machine) are non-locally distributed over the whole material making the charge density to decrease, whereby local concentrations of electrostatic charges are avoided. Moreover it is possible that electrical charges may flow back after interrupting contact with electrically conducting materials. It is clear that such low electrical surface resisitivity is highly appreciated, the more as the said surface resistivity remains substantially unchanged before and after processing. Same low resistivity after processing is indeed required as electrostatic charges remain a problem related with maintenance of processed film materials, e.g. while projecting motion picture print films.

The said "antistatic subbing layers", providing adhesion between the web sheet and the other layers to be coated thereon, are normally coated at both sides of the said web sheet or support. The materials having light-sensitive silver halide emulsion layers at one side of the subbed supports are said to be "single-side" coated.

In case of a single-side coated material as in the present invention the compounds providing "permanent antistatic properties" are electronically conductive compounds and, more particularly, (co)polymer compounds selected from the group consisting of a polymer with acidic groups optionally further crosslinked by aziridines; a mixture of water-soluble conductive polymers, containing sulphonic acid groups, sulphuric acid groups or carboxylic acid groups together with a hydrophobic polymer and a crosslinking or curing agent, a (poly)phosphazene, a graft polymer of polyphosphazenes with polyalkylene glycols; (co)polymers of a diallyldialkylammonium salt; polyalkyleneimine grafted vinyl polymers; a copolymer of styrene sulphonic acid and a hydroxyl group containing monomer crosslinked by methoxyalkylmelamine; the said copolymer of styrene sulphonic acid being crosslinked by a hydrolyzed metal lower alkoxide; polymer complexes containing polyalkylene oxide units; a combination of polymerized oxyalkylene oxide units and a fluorine containing inorganic salt; a polyoxyalkylene in combination with a thiocyanate, iodide, perchlorate, or periodate; a highly crosslinked vinylbenzyl quaternary ammonium polymer in combination with a hydrophobic binder; a sulphonated anionic microgel latex, polymers and copolymers of pyrrole, furan, aniline, vinylcarbazole and pyridine and their derivatives, tetracyanoquinone (TCNQ) complex and polyarenemethylidenes and derivatives thereof. Many of the known electronically conductive polymers among them are highly colored which makes them less suitable for use in photographic materials of to the present invention, but some of them of the group of the polyarenemethylidenes, as e.g. polythiophenes and polyisothianaphthenes are not prohibitively colored and transparent, at least when coated in thin layers. As a result thereof polythiophene derivatives are a preferred type of electronically conductive compounds for use in the subbing layer at the light-sensitive side of the transparent polyester support of the material according to the present invention.

The production of such conductive polythiophenes has been described in preparation literature mentioned in the above mentioned book: "Science and Applications of Conducting Polymers", p. 92.

For ecological reasons the coating of antistatic layers should proceed, where possible, from aqueous solutions by using organic solvents in amounts as low as possible. The production of antistatic coatings from aqueous coating compositions being dispersions of polythiophenes in the presence of polyanions has described in EP-A 0 440 957. Thanks to the presence of the polyanion the polythiophene compound is kept in dispersion.

Preferably said polythiophene has thiophene nuclei substituted with at least one alkoxy group, or —$O(CH_2CH_2O)_nCH_3$ group, n being an integer having a value from 1 to 4, or, most preferably, thiophene nuclei that are ring closed over two oxygen atoms with an alkylene group including such group in substituted form.

Preferred polythiophenes for use in materials according to the present invention are made up of structural units corresponding to the following general formula (I):

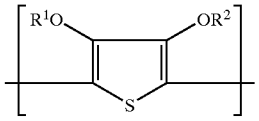

in which:

each of $R^1$ and $R^2$ independently represents hydrogen or a $C_{1-4}$ alkyl group or together represent an optionally substituted $C_{1-4}$ alkylene group or a cycloalkylene group, preferably an ethylene group, an optionally alkyl-substituted methylene group, an optionally $C_{-1-12}$ alkyl- or phenyl-substituted 1,2-ethylene group, a 1,3-propylene group or a 1,2-cyclohexylene group.

The most preferred compound however is poly(3,4-ethylenedioxy-thiophene), (PEDT) with following formula (II):

(II)

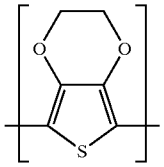

The preparation of said polythiophene and of aqueous polythiophene-polymeric polyanion dispersions containing said polythiophene has been described EP-A 0 440 957, cited above.

The synthesis proceeds, in the presence of said polymeric polyanion compounds, by oxidative polymerization of 3,4-dialkoxythiophenes or 3,4-alkylenedioxythiophenes according to the following general formula (III):

(III)

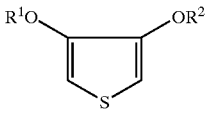

wherein:

$R^1$ and $R^2$ are as defined in general formula (I), with oxidizing agents typically used for the oxidative polymerization of pyrrole and/or with oxygen or air in the presence of said polyacids, preferably in aqueous medium containing optionally a certain amount of organic solvents, at temperatures of 0 to 100° C.

The polythiophenes get positive charges by the oxidative polymerization. The location and number of said charges cannot be determined with certainty and therefore they are not mentioned in the general formula of the repeating units of the polythiophene polymer. The size of polymer particles in the coating dispersion is is in the range of from 5 nm to 1 μm, preferably in the range of 40 to 400 nm. Suitable polymeric polyanion compounds required for keeping said polythiophenes in dispersion are provided by acidic polymers in free acid or neutralized form. The acidic polymers are preferably polymeric carboxylic or sulphonic acids. Examples of such polymeric acids are polymers containing repeating units selected from the group consisting of acrylic acid, methacrylic acid, maleic acid, vinyl sulfonic acid and styrene sulfonic acid or mixtures thereof.

The anionic acidic polymers used in conjunction with the dispersed polythiophene polymer preferably have a content of anionic groups of more than 2% by weight with respect to said polymer compounds to ensure sufficient stability of the dispersion. Suitable acidic polymers or corresponding salts have been described e.g. in DE-A's 25 41 230, 25 41 274 and 28 35 856, in EP-A's 0 014 921 0 069 671 and 0 130 115, and in U.S. Pat. Nos. 4,147,550; 4,388,403 and 5,006,451. The polymeric polyanion compounds may consist of straight-chain, branched chain or cross-linked polymers. Cross-linked polymeric polyanion compounds with a high amount of acidic groups are swellable in water and are named microgels. Such microgels have been disclosed e.g. in U.S. Pat. Nos. 4,301,240, 4,677,050 and 4,147,550.

The molecular weight of the polymeric polyanion compounds being polyacids is preferably in the range from 1,000 to 2,000,000 and more preferably in the range from 2,000 to 500,000. Polyacids within the above criteria are commercially available, for example polystyrene sulfonic acids and polyacrylic acids, or may be produced by known methods (ref. e.g. Houben-Weyl, Methoden der organischen Chemie, Vol. E20, Makromolekulare Stoffe, Teil 2, (1987), pp. 141 ff.

Instead of the free polymeric polyacids applied in conjunction with the polythiophenes it is possible to use mixtures of alkali salts of said polyacids and non-neutralized polyacids, optionally in the presence of monoacids. Free acid groups of the polyanionic polymer may be allowed to react with an inorganic base, as with sodium hydroxide, in order to obtain a neutral polymer dispersion before coating.

The weight ratio of polythiophene polymer to polymeric polyanion compound(s) can vary widely, for example from about 50/50 to 15/85. The most preferred polymeric polyanion for use in combination with the polythiophene derivative used in materials according to the present invention, e.g. PEDT, is polystyrene sulphonate (PSS).

According to the present invention an element is thus provided, wherein, in the subbing layer at the light-sensitive side (where one or more light-sensitive emulsion layer(s) are coated, optionally having non-light sensitive intermediate layers inbetween), the said antistatic agent providing an unchanged electrical resistivity of this subbing layer before and after processing of said material, is a polythiophene compound, incorporated in said subbing layer.

In a particularly preferred embodiment the element or material according to the present invention, has, incorporated in said subbing layer, a polythiophene compound being poly (3,4-ethylene-dioxy-thiophene) (PEDT). Moreover, in a further preferred embodiment, said polythiophene compound is present as an aqueous dispersion of a polythiophene compound/polymeric anion complex in the said subbing layer in the material according to the present invention.

Besides the embodiments described hereinbefore wherein the conductive compound is a polythiophene compound, in another embodiment, the material according to the present invention has a subbing layer at the light-sensitive side wherein the said antistatic agent providing an unchanged electrical resistivity of this subbing layer before and after processing of said material, is a metal oxide compound, said metal being selected from the group consisting of tin, indium tin, vanadium, zinc, manganese, titan, indium, silicium, magnesium, barium, molybdene and tungsten. Said metal oxides, such as vanadium pentoxide, as disclosed e.g. in WO 91/02289, U.S. Pat. No. 5,221,598; ZnO, $SnO_2$, MgO, as disclosed in e.g. U.S. Pat. No. 5,238,801, colloidal manganese dioxide as disclosed in EP-A 0 504 826; oxides from Zn, Ti, In, Si, Mg, Ba, Mo, W, V, as disclosed in EP-A 0 569 821; in combination with a fluorine containing (co)polymer according to EP-A 0 552 617, a reaction product of a metal oxide sol and a chitosan salt as in EP-A 0 531 006; heteropolycondensates of tin and boron oxide as described in WO 90/013851; doped metal oxides; silica and modified silica compounds, as in U.S. Pat. Nos. 4,895,792; 5,385,986 and 5,236,818; EP-A's 0 334 400, EP-A 0 438 621, EP-A 0 296 656 and EP-A 0 444 326, conductive polymers with acidic groups optionally further crosslinked e.g. by aziridines or other compounds, such as those disclosed in U.S. Pat. No. 4,960,687; 4,891,308; 5,077,185 and 5,128,233; in EP-A's 0 318 909, 0 439 181, 0 486 982 and 0 505 626 and in DE-A 41 03 437; mixtures of a water-soluble conductive polymer, containing e.g. sulphonic acid groups, sulphuric acid groups or carboxylic acid groups and in addition thereto a hydrophobic polymer and a crosslinking or curing agent as disclosed e.g. in U.S. Pat. Nos. 5,013,637; 5,079,136; 5,098,822; 5,135,843 and EP-A's 0 432 654, 0 409 665 and 0 391 402; (poly)phosphazene derivatives, as described in U.S. Pat. Nos. 4,948,720 and 4,898,808 and in WO 90/08978; graft polymers of polyphosphazenes with polyalkylene glycols as disclosed in EP-A 0 304 296; (co)polymers of a diallyldialkylammonium salt as disclosed in EP-A 0 320 692, polyalkyleneimine grafted vinyl polymers such as disclosed in U.S. Pat. No. 5,153,115, copolymer of styrene sulphonic acid and a hydroxyl group containing monomer crosslinked by methoxyalkylmelamine as described in WO 91/18061, the same copolymer but crosslinked by a hydrolyzed metal lower alkoxide as disclosed in WO 91/18062; polymer complexes containing polyalkylene oxide units as disclosed in JP-A 62/286038; a combination of polymerized oxyalkylene oxide units and a fluorine containing inorganic salt as disclosed in EP-A 0 170 529; a polyoxyalkylene in combination with a thiocyanate, iodide, perchlorate, or periodate as in U.S. Pat. No. 4,272,616; a highly crosslinked vinylbenzyl quaternary ammonium polymer in combination with a hydrophobic binder as described in *Research Disclosure,* June 1977, Item 15840 and U.S. Pat. No. 3,958,995 sulphonated anionic microgel latices as described in *Research Disclosure,* October 1977, Item 16258; polymers and copolymers of pyrrole, furan, aniline, vinylcarbazole, pyridine, and other hetero-cycles and their derivatives as disclosed in several patents, usually outside the scope of imaging science, as in EP-A's 0 537 504, 0 326 864, 0 264 786, 0 259 813, 0 195 381 and 0 469 667; in DE-A's 39 40 187, 37 43 519, 37 34 749 and 37 16 284 and in WO 96/01480; and so-called TCNQ-complexes as e.g. N-butyl-isochinolinium-tetracyanoquinone-dimethane. References with respect to TCNQ-complexes can be found in "*Handbook of organic conductive molecules and polymers*", Vol. 1, Chapter 4, p. 229, and in *J. Am. Chem. Soc.,* Vol. 84, (162) p. 3370.

In a further embodiment of the present invention in said material said conductive compound is a mixture of different types of conductive compounds, mentioned hereinbefore.

According to the present invention an element or material as disclosed before is thus provided, wherein an electrical resistivity is between $1\times10^5$ and $1\times10^{12}$ Ω/□, measured as described in Research Disclosure June 1992, item 33840 for said subbing layer, as a layer having the lowest resistance.

In a more preferred embodiment of the present invention said element or material has an electrical resistivity at the emulsion side of the element or material between $1\times10^7$ and $1\times10^{10}$ Ω/□.

The other layers making part of the photographic element of the present invention, apart from the (antistatic) layers as described hereinbefore, will be explained more in detail now.

A common support of a photographic silver halide emulsion material is a transparent polymeric hydrophobic resin support (although in the alternative a hydrophobic resin coated paper support, used for other purposes than the element of the present invention may also be used together with the layer arrangement as set forth in the present invention). Useful transparent polymeric supports include e.g. cellulose nitrate film, cellulose acetate film, polyvinylacetal film, polystyrene film, polyethylene terephthalate film, polyethylene naphthalate film, polycarbonate film, polyvinylchloride film or poly-olefin films such as polyethylene, polynaphthalene or poly-propylene film. Hydrophobic resin supports are well known to those skilled in the art and are made e.g. of polyester, polystyrene, polyvinyl chloride, polycarbonate, preference being given to polyethylene terephthalate and polyethylene naphthalate as polyester supports, giving rise to the problem of laser subtitling set forth above in the background and in the objects of the present invention. Hydrophobic resin supports of the materials according to the present invention are further, as has been made already clear in the description above, provided with one or more subbing layers known to those skilled in the art for coating and adhering purposes to the adjacent hydrophilic colloid layer, as described e.g. for polyethylene terephthalate in U.S. Pat. Nos. 3,397,988, 3,649,336, 4,123,278 and 4,478,907, wherein in said subbing layers the conductive compound providing low lateral surface resisitivity as described hereinbefore is incorporated. The thickness of such organic resin film is preferably comprised between 0.03 and 0.35 mm. In a most preferred embodiment of the present invention the support is a polyethylene terephthalate layer provided with subbing layers at both sides, the subbing layer at the light-sensitive comprising the compound(s) providing permanent antistatic properties (electronic conductivity). This subbing layer, inclusive for all components required, more particularly, the compound providing permanent—electronic—antistatic character, present (at least) at the light-sensitive side of the support, can be applied before or after stretching of the polyester film support. The polyester film support is preferably biaxially stretched at an elevated temperature of e.g. 70–120° C., reducing its thickness by about ½ to ⅙ or more and increasing its area 2 to 9 times. The stretching may be accomplished in two stages, transversal and longitudinal in either order or simultaneously. The subbing layer is preferably applied by aqueous coating between the longitudinal and transversal stretch, in a thickness of 0.1 to 5 $\mu$m. In case wherein subbing layers contain a homopolymer or copolymer, examples of said homopolymers or copolymers suitable for use in the subbing layer are e.g. polyvinyl chloride, polyvinylidene chloride, a copolymer of vinylidene chloride, an acrylic ester and itaconic acid, a copolymer of vinyl chloride and vinylidene chloride, a copolymer of vinyl chloride and vinyl acetate, a copolymer of butylacrylate, vinyl acetate and vinyl chloride or vinylidene chloride, a copolymer of vinyl chloride, vinylidene chloride and itaconic acid, a copolymer of vinyl chloride, vinyl acetate and vinyl alcohol etc. Polymers that are water dispersable are preferred since they allow aqueous coating of subbing layers which is in favour of ecology.

Further suitable coating agents for layers building-up the material according to the present invention include non-ionic agents such as saponins, alkylene oxides as e.g. polyethylene glycol, polyethylene glycol/polypropylene glycol condensation products, polyethylene glycol alkyl esters or polyethylene glycol alkylaryl esters, polyethylene glycol esters, polyethylene glycol sorbitan esters, polyalkylene glycol alkylamines or alkylamides, silicone-polyethylene oxide adducts, glycidol derivaties, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Other suitable surfactants include perfluorinated compounds.

The silver halide photographic element or material according to the present invention thus contains the conductive compound, providing permanent antistatic properties—otherwise called "substantially unchanged electrical resistivity" for the layer showing the best conductivity and for the silver halide photographic material or element at the light-sensitive side, wherein said silver halide photographic material comprises a subbed support at both sides of said single-side coated (light-sensitive layers being present at only one side of the material) material, and wherein at said "light-sensitive side" at least one light-sensitive layer is present, said layer comprising one or more light-sensitive silver halide emulsions, a protective antistress layer and, optionally, an afterlayer, wherein at least one of said layers, particularly the subbing layer, contains said electronically conductive compound.

In the antistress layer(s) from the materials according to the present invention latex-type polymers or copolymers may be included, besides hydrophilic colloid binders, wherein those polymers or copolymers are chosen in order to be mixed homogeneously therewith. Proteinaceous colloids, e.g. gelatin, polysaccharide, and synthetic substitutes for gelatin as e.g. polyvinyl alcohol, poly-N-vinyl pyrrolidone, polyvinyl imidazole, polyvinyl pyrazole, polyacrylami-de, polyacrylic acid, and derivatives thereof can be used therefore. Furthermore the use of mixtures of said hydrophilic colloids is not excluded. Among these binders the most preferred is gelatin. Conventional lime-treated or acid treated gelatin can be used.

The preparation of such gelatin types has been described in e.g. "The Science and Technology of Gelatin", edited by A. G. Ward and A. Courts, Academic Press 1977, page 295 and next pages.

The gelatin can also be an enzyme-treated gelatin as described in Bull. Soc. Sci. Phot. Japan, N° 16, page 30 (1966). In order to minimize the amount of gelatin, however can be replaced in part or integrally by synthetic polymers as cited hereinbefore or by natural or semi-synthetic polymers. Natural substitutes for gelatin are e.g. other proteins such as zein, albumin and casein, cellulose, saccharides, starch, whether or not in oxidized form, and alginates. Semi-synthetic substitutes for gelatin are modified natural products as e.g. gelatin derivatives obtained by conversion of gelatin with alkylating or acylating agents or by grafting of polymerizable monomers on gelatin, and cellulose derivatives such as hydroxyalkyl cellulose, carboxymethyl cellulose, phthaloyl cellulose, cellulose sulphates, etc. Cross-linked copolymers may be applied, and when applied preferable amounts are at least 10% by weight versus the amount of hydrophilic colloid present in the antistress layer or layers. In addition the said copolymers may be present in an optionally present outermost gelatin free coating applied thereover.

In the material according to the present invention a preferred protective antistress layer is made from gelatin hardened up to a degree corresponding with a water absorption of less than 2.5 grams of water per $m^2$ and more preferably of at most 1 gram per $m^2$. The gelatin coverage in the protective layer is preferably not higher than about 1.20 g per $m^2$ and is more preferably in the range of 0.60 to 1.20 g per $m^2$. Gelatin in the antistress layer may partially be replaced by colloidal silica as it gives rise to a further improvement of the obtained properties according to the present invention. Preferably colloidal silica having an average particle size not larger than 10 nm and with a surface area of at least 300 sq.m. per gram is used, the colloidal silica being present at a coverage of at least 50 mg per $m^2$. Further the coverage of said colloidal silica in the antistress layer is preferably in the range of 50 mg to 500 mg per $m^2$. Particularly good results which are fully in accordance with the present invention are obtained by using a protective antistatic layer comprising besides the conductive compound as claimed, at least 50% by weight of colloidal silica versus the said conductive compound. Especially preferred colloidal silica particles have a surface area of 500 $m^2$ per gram and an average grain size smaller than 7 nm. Such type of silica is sold under the name KIESELSOL 500 (KIESELSOL is a registered trade name of Bayer A G, Leverkusen, Germany).

In admixture with the hardened gelatin the antistress layer covering the light-sensitive layer(s) may further contain friction-lowering substance(s) such as dispersed wax particles (carnaubawax or montanwax) or polyethylene particles, fluorinated polymer particles, silicon polymer particles etc., in order to further reduce the sticking tendency of the layer especially in an atmosphere of high relative humidity.

The gelatin binder of the material can be forehardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloylhexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds disclosed in EP-A 0 408 143.

Photographic silver halide emulsion materials or elements according to the present invention, in favour of sharpness or image definition, comprise an antihalation undercoat or layer in order to reduce light scattering, wherein said antihalation undercoat is in direct contact with the subbing layer at the light-sensitive side of the transparent support or is separated from it by a thin indermediate gelatin layer. Advantages offered by antihalation layers are e.g. well-known from microfilms and from radiographic applications, offering a solution for the problem of image definition in circumstances wherein very high demands are posed as in single-side coated recording materials for mammography (see e.g. EP-A's 0 610 609,0 712 036 and 0 874 275) brought into contact with an intensifying screen at the side of the film support having the light-sensitive emulsion layer(s) or for laser recording as e.g. described in EP-A 0 610 608 and 0 794 456 for the registration of digitally stored images. As a function of the processing times and as a function of the need to have processed images free from residual stain or color the antihalation layer is present in the backing layer (for rapid processing applications) or as an antihalation undercoat at the light-sensitive side, wherein, from the point of view of reduction of light scattering, presence of an antihalation undercoat at the light-sensitive side is preferred.

Antihalation layers and dyes, useful in the material or element of the present invention, are e.g. merostyryl dyes, oxonol dyes, pyrazolones, pyrrols, thiophenes, etc., as those described in EP-A's 0 489 973, 0 586 748, 0 587 229, 0 587 230, 0 656 401, 0 724 191, 0 781 816 and 0 786 497.

Antihalation dyes, present in the antihalation undercoat covering the subbing layer at the light-sensitive side of the support of the material according to the present invention are non-spectrally sensitizing dyes which are widely used in photographic elements in order to absorb reflected and scattered light, in a limited or very broad wavelength range. Examples of the said dyes have been described e.g. in U.S. Pat. Nos. 3,560,214 and 4,857,446 and in EP-A's given above. The filter or accutance dye(s) can be coated in layers of photographic elements in the form as has been described in EP-A's 0 384 633, 0 323 729, 0 274 723, 0 276 566, 0 351 593; in U.S. Pat. Nos. 4,900,653; 4,904,565; 4,949,654; 4,940,654; 4,948,717; 4,988,611 and 4,803,150; in Research Disclosure Item 19551 (July 1980); in EP-A 0 401 709 and in U.S. Pat. No. 2,527,583, these examples however being not limitative. More than one antihalation layer is optionally present, e.g. in multilayer materials wherein the light-sensitive layer, as set forth hereinbefore, is part of a multilayer arrangement, optionally including one or more intermediate layers between light-sensitive emulsion layers, wherein said emulsion layers have been made sensitive by spectral sensitization, to differing wavelength ranges, e.g. being sensitive to blue, green and red light as is well-known from color sensitive materials, and wherein the said intermediate layers may contain antihalation dyes in order to enhance sharpness or image definition in a limited wavelength range as described e.g. in EP-A 0 252 550 for color print materials and in EP-A 0 582 000 for color negative recording materials.

According to the present invention an element is provided, wherein said antihalation undercoat comprises one or more dye(s), at least one yellow non-diffusing dye that absorbs blue light and is removable and/or decolorizable in a processing bath, and is chosen from the group consisting of merostyryl dyes and monomethine oxonol dyes. Preferably said merostyryl dyes are pyrazolone-5 merostyryl dyes having a hydroxybenzal moiety and at least one carboxy or carbamoyl group on the pyrazolone ring or symmetrical monomethine oxonols of pyrazolone. Particularly preferred is a yellow non-diffusing merostyryl dye (I) or a monomethine oxonol dye (II) as disclosed in EP-A 0 252 550, the structures of which has been given hereinafter, without however being limitative thereto. Said dyes may be added to the antihalation coating composition in form of a gelatinous dispersion, a colloidal silica dispersion or a (gelatinous or colloidal silica) solid particle dispersion, as disclosed e.g. in EP-A 0 569 074.

(I)

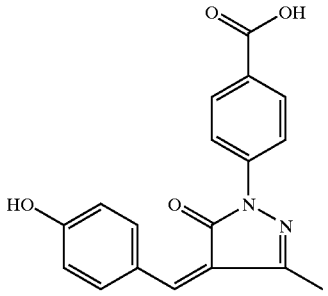

(II)

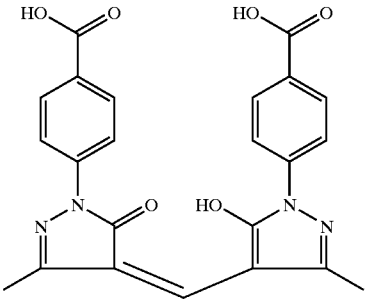

According to another embodiment of the present invention an element is provided, wherein said element is a motion picture projection color print film material, comprising a transparent film support and coated thereon in succession, a blue-sensitive silver halide emulsion layer comprising a yellow-forming coupler, a red-sensitized silver halide emulsion layer comprising a cyan-forming coupler, an intermediate layer, a green-sensitized silver halide emulsion layer comprising a magenta-forming coupler, and an anti-stress layer, wherein between said support and said blue-sensitive silver halide emulsion layer a yellow antihalation undercoat is provided, which comprises at least one yellow non-diffusing dye that absorbs blue light and is removable and/or decolorizable in a processing bath. As already set forth hereinbefore said at least one dye is preferably chosen from the group consisting of a merostyryl dye and a monomethine oxonol dye, preferably being a (symmetrical) monomethine oxonol, and even more preferably a pyrazolone-type monomethine oxonol, whereas preferred merostyryl dyes are of the pyrazolone-5-type, having a hydroxybenzal moiety and at least one carboxy or carbamoyl group on the pyrazolone ring.

In still another embodiment said element is a color print film material, wherein between said blue-sensitive silver halide emulsion layer and said red-sensitized silver halide emulsion layer a bluish antihalation intermediate layer is provided, which comprises at least one blue non-diffusing dye that absorbs red light and is removable and/or decolorizable in a processing bath. Said at least one blue non-diffusing dye is at least one pentamethine oxonol-type barbituric acid derivative dye, without however being limited thereto. Preferred pentamethine oxonols of the barbituric acid type preferably have at least one halogen atom, hydroxy, alkyl, alkoxy, carboxy, carbamoyl, sulphamoyl, alkoxycarbonyl, aryloxycarbonyl, alkoxysulphonyl, aryloxysulphonol, and heterocyclylsulphonyl, e.g. o-sulphamoylphenyl, p-methoxy-phenyl, and 3-hydroxy-4-carboxyphenyl groups.

As a particularly preferred pentamethine oxonol dye, the dye (III) has been given hereinafter.

(III)

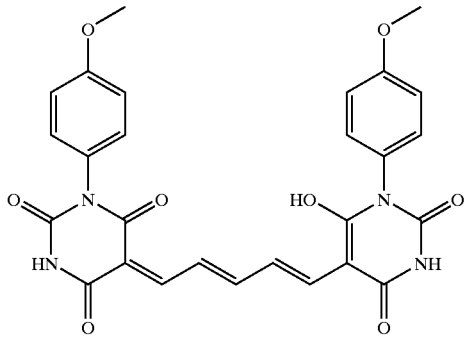

-continued

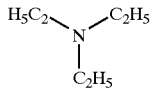

In order to provide excellent subtitling properties for such color print material, according to the present invention, the antihalation undercoat of said material or element comprises a high temperature boiling solvent.

In a further preferred embodiment of the present invention said element has a high temperature boiling solvent, which is present in a total amount of from 0.1 g/m$^2$ up to not more than 0.5 g/m$^2$.

Antihalation dyes as mentioned hereinbefore can also be present in the backing layer arrangement, and more particularly in the layer between subbing layer and topcoat layer, i.a. the backing layer comprising the lubricant, providing the desired friction coefficient before and after processing, the value of which remains within a range between 0.20 and 0.30 when measured versus stainless steel as set forth hereinbefore.

Also in color negative films same antihalation dye layers may be provided as has been described e.g. in EP-A 0 582 000 or, in the alternative, in a film wherein use is made of only one cyan-colored filter dye containing layer as in U.S. Pat. No. 5,723,272. Other antihalation dyes suitable for use in color print materials are those given hereinafter, which can moreover advantageously be used e.g. in a sound recording film wherein an antihalation layer may be provided, e.g. containing more than one dye, as a yellow pigment, a blue pigment, a red dye and/or a mixture of at least two of those dyes or pigments. Said sound recording film, coated on a clear base support, although containing the commonly applied dyes, preferably contains the dyes or pigments the structures of which have been given hereinafter as dye (IV), representing a yellow pigment, dye (V), representing a red pigment and dye (VI) representing a blue pigment respectively.

(IV)

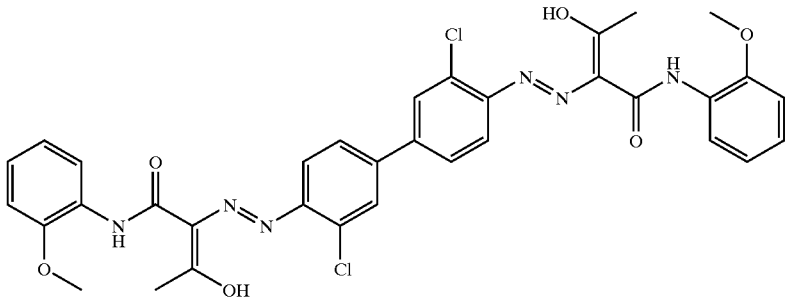

-continued (V)

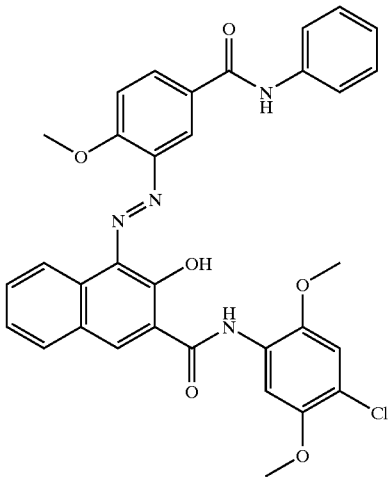

(VI)

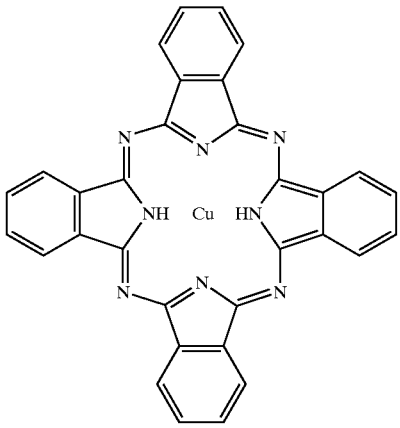

A black and white silver halide motion picture sound recording film may be used, said film comprising a support bearing at least one silver halide emulsion layer, wherein said film is spectrally sensitized both above and below 600 nm as disclosed in U.S. Pat. No. 5,955,255, thus being panchromatically sensitized as in GB 449,546 and corresponding FR 784,027. Such film may be used for recording multiple optical soundtracks by exposing said film with a first source of radiation having a peak wavelength of less than or equal to 600 nm, recording a second digital soundtrack by exposing said film with a second source of radiation having a peak wavelength of greater than 600 nm, and processing said exposed film to form first and second digital soundtrack silver images. Suitable antihalation dyes, selected e.g. from the dyes or pigments given hereinbefore may be advantageously be coated in an antihalation undercoat. Typical black and white sound recording films designed for recording analog soundtracks comprise a relatively fine grain, having e.g. a grain size less than 0.35 $\mu$m for a monodispersed silver halide emulsion, which provides a high contrast overall gradient being greater than 3.7, more preferably greater than 3.8 and even more preferably greater than 3.9, desirable for recording the soundtrack with sharp edges. In order to reach such high gradations in a short processing time it is advantageous to develop said sound recording film having fine emulsion grains rich in silver chloride in a developer known from graphic arts, as has e.g. been described in U.S. Pat. No. 4,659,647 wherein half-tone dot or line mages have been generated and in U.S. Pat. No. 4,756,990 wherein a method in order to provide high contrast development of an imagewise exposed material. Short processing times may provide an opportunity to make use in the sound laboratory of compact processors in form of a table top processor. So a stable graphic developer as e.g. G101® (trademark product from Agfa-Gevaert N.V., Belgium), without however being limited thereto, is advantageously used, thereby providing use of lower amounts of chemicals. White light sources such as tungsten lamps have conventionally been used to record analog soundtracks. Accordingly, the native sensitivity of many silver halide emulsions in the blue region of the electromagnetic spectrum (e.g., 380–500 nm) has been sufficient for such white light recording. Where additional speed is desired for white light recording or where emulsions are used which lack sufficient native sensitivity in the visible light region, sound recording films have been sensitized for analog recording with blue and/or green sensitizing dyes. Otherwise digital soundtrack recording is typically performed by exposing a sound recording film to a modulated coherent radiation light source having a narrow band width, such as a modulated laser beam or light emitting diode or diode array. So sound recording films have been made which are optimally spectrally sensitized to provide a peak sensitivity to match a particular digital recording device, along with providing adequate sensitivity for recording anolog soundtracks with white light sources.

A soundtrack image in a motion picture print film may, apart from originating from the panchromatic black and white sound recording film spectrally sensitized both above and below 600 nm, alternatively comprise e.g. a soundtrack negative in a chromogenic soundtrack recording film by exposing said film and processing said exposed film with a color developer process to form a dye soundtrack negative, and printing a soundtrack onto a negative-working motion picture print film by exposing the motion picture print film through the dye soundtrack negative and processing the exposed print film to form a positive soundtrack. The light-sensitive emulsion layer of the sound recording film preferably comprises green or red light-sensitive silver halide emulsion grains and a cyan or magenta dye-forming coupler in the substantial absence of yellow dye-forming coupler. Most preferred is a light-sensitive emulsion layer of the sound recording film comprising green and red light-sensitive silver halide emulsion grains and cyan and magenta dye-forming couplers in the substantial absence of yellow dye-forming coupler as disclosed in U.S. Pat. No. 5,856,057. Dyes presented above may advantageously be used in an antihalation layer of such a chromogenic sound film.

Dye pigments may be present in dispersed form as disclosed in EP-A 0 252 550, but also in form of microprecipitated filter dye dispersion form as e.g. as a microprecipitated oxonol filter dye, described e.g. in U.S. Pat. Nos. 5,274,109; 5,326,687; 5,470,695; 5,624,467 and 5,879,869. When a microprecipitation process is used for dispersing photographic filter dyes, it is essential that the filter dye has ionizable acid sites on the filter dye molecule, so that after adding sufficient aqueous hydroxide in order to dissolve the filter dye, acidifying the filter dye composition in the presence of a dispersing aid in order to reprotonate the ionizable acid sites on the dye molecule provides a microprecipitated dispersion of the filter dye that is insoluble in aqueous media at pH values less than 3 and soluble in aqueous media at pH greater than 10.

It is essential in the context of the present invention to incorporate a high temperature boiling solvent in the antihalation undercoat, being the antihalation layer coated most adjacent to the subbing layer, wherein optionally a (thin) gelatinous layer may be present between said subbing layer and said antihalation undercoat at the light-sensitive side of the support of the color print film material of the present invention in order to guarantee sufficiently well subtitling properties. The high temperature boiling solvent, according to the present invention should therefore be present in an amount of from 0.1 to 0.5 g/m$^2$, in the antihalation undercoat at the light-sensitive side of the support as according to the present invention it is an essential feature that the silver halide color motion picture print film element has a support capable of being marked by means of a laser, like e.g. a polyester support, and more preferably a transparent polyethylene terephthalate film support. The high temperature boiling solvent can optionally further be present in the emulsion layer most close to the support at the light-sensitive side of the material in an amount of from 0.2 to 1.0 g/m$^2$. In case of a color print material this means that the high temperature boiling solvent may thus be present in the blue-sensitive emulsion layer of a color print material. Its presence provides an optimized laser subtitling quality.

A silver halide photographic motion picture projection film element which upon being exposed and color processed is suitable to be marked for subtitling purposes by a laser beam as disclosed hereinbefore, further comprises in its subbing layer unit at least one light-sensitive stabilizer and at least one chemical compound having reducing properties. Said chemical compound having reducing properties preferably is an oxidant and/or a flame retarding agent selected form the group of compounds consisting of phosphites having the general formula O═P(OR)3; organic sulfides R—S—R and sterically hindered phenols, R representing therein an alkyl or an aryl group and whereas said light-stabilizer is a benzophenone compound absorbing ultraviolet radiation. Said sterically hindered phenols are preferably selected from the group consisting of di-esters of di-t-butylphenol and 2,5-dialkylester substituted hydroquinone and said element being laser ablatable without detriment to said film element has e.g. been disclosed in U.S. Pat. No. 5,981,155. A solution for the remaining disadvantage of that invention, related with too high a load of organic substances in the antihalation layer has thus been found in the present invention by providing in said antihalation undercoat, making part of the "subbing unit" as set forth in the said US-Application, a high temperature boiling solvent, and more particularly the solvent the formula of which has been given hereinafter as formula (VII).

(VII)

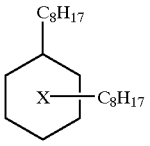

According to the present invention low amounts of said high boiling solvent, in the range of from 0.1 up to not more than 0.5 g/m$^2$ are sufficient in order to provide good laser marking ability.

When said color print material comprises, as set forth in the statement of the present invention (1) a subbing layer comprising an antistatic agent providing a substantially unchanged electrical resistivity of the said element before and after processing it, (2)an antihalation undercoat comprises a high temperature boiling solvent as set forth hereinbefore and on the non-light sensitive backing layer side (3) a backing layer having a friction coefficient versus stainless steel which remains unchanged in the range between 0.20 and 0.30 before and after processing, even after removal of the topcoat layer of said backing layer during processing in an alkaline developer, then all objects of the present invention as set out hereinbefore, are fullfilled. If the coefficient of friction is below 0.20, there remains a significant danger that long, slit rolls of the photographic film will become unstable in storage or shipping and become telescoped or dished, a condition common to unstable film rolls; whereas if the coefficient of friction is above 0.30 at manufacture or becomes greater than 0.30 after photographic film processing, a common condition of non-process surviving topcoat lubricants, the photographic film transport characteristics become poorer, particularly in some types of photographic film projectors.

According to the present invention, in order to attain said almost unchanged friction coefficient versus stainless steel unchanged in the range between 0.20 and 0.30 before and after processing, the element or material contains a lubricant in at least the subbing layer of the non-light-sensitive backing layer, said lubricant being a compound selected from the group consisting of carnaubawax, montanwax, polyethylene, a fluorinated polymer, a silicon polymer, higher alcohol esters of fatty acids, higher fatty acid calcium salts, metal stearates, water dispersible siloxane-containing polyurethane formed from prepolymer containing anionic and non-anionic hydrophilic groups, paraffins and the like as described in older well-known U.S. Pat. Nos. 2,588,756;

3,121,060; 3,295,979; 3,042,522 and 3,489,567. From more recent patents it can be learned to make use of core-shell polymer particles with cross-linked core impregnated with diffusible lubricant as in EP-A 0 824 219 and the corresponding U.S. Pat. No. 5,695,919; cellulose acetate, cellulose nitrate and perfluorinated polymer particles in an outermost backing layer as in EP-A 0 855 618 and in the corresponding U.S. Pat. No. 5,766,836; fluoro acrylate or methacrylate interpolymers in a stain resistant overcoat layer, wherein said interpolymers have two different segments, one of which is fluorinated and oleophobic and the other of which is hydratable as has been described in EP-A 0 935 165 and the corresponding U.S. Pat. No. 6,004,735; water dispersible siloxane-containing polyurethane formed from prepolymer containing anionic and non-anionic hydrophilic groups, exhibiting superior lubricity as in U.S. Pat. No. 5,932,405 and in U.S. Pat. No. 5,958,658, wherein polymer particles less than 500 nm are present, said particles having specific hydrophobic groups impregnated with a water insoluble lubricant by co-polymerization.

Such friction-lowering lubricants, further providing a better scratch resistance may additionally be present in the outermost backing layer in order to further reduce the sticking tendency of the layer especially in an atmosphere of high relative humidity.

Aqueous dispersed lubricants are strongly preferred since lubricants, in this form, can be incorporated directly into the aqueous protective topcoat formula, thus avoiding a separately applied lubricant overcoat on the protective topcoat layer. The aqueous dispersed lubricants of carnauba wax, polyethylene oxide, microcrystalline wax, paraffin wax, silicones, stearates and amides work well as incorporated lubricants in the aqueous, protective topcoat. However, the aqueous dispersed lubricants of carnauba wax and stearates are preferred for their effectiveness in controlling friction at low lubricant levels and their excellent compatibility with other aqueous dispersed polymers as, e.g. polyurethanes.

In addition to lubricants, matting agents are important for improving the transport of the film on manufacturing, printing, processing, and projecting equipment. Also, these matting agents can reduce the potential for the protective topcoat to adhere to the emulsion side in a wound-up roll in that some sticking is noticed between the protective topcoat and the emulsion side surface layer when they are separated. Preferably therefore the topcoats of the present invention contain matte particles. The matting agent may be silica, calcium carbonate, or other mineral oxides, glass spheres, ground polymers and high melting point waxes, and polymeric matte beads. Polymeric matte beads are preferred because of uniformity of shape and uniformity of size distribution. The matte particles should have a mean diameter size of about 0.5 to about 3 $\mu$m. However, preferably the matte particles have a mean diameter of from about 0.75 to about 2.5 $\mu$m. The matte particles can be employed at a dry coating weight of about 1 to about 100 mg/m$^2$. However, the preferred coating weight of the matte particles is about 15 to about 65 mg/m$^2$. Apart from the matting particles as already mentioned hereinbefore presence of permanent matting agents in the overcoat layer at the emulsion side, at the backing layer or in both of them is recommended as providing further resistance to generation of dirt and abrasion as has been disclosed in EP-A 1 113 317.

Present in the subbing layer at the back layer side, said lubricating agents as those set forth above, thus provide, also after processing, a friction coefficient that ensures good transport characteristics during manufacturing and customer handling of the photographic film material or element, even when the outermost is removed in the alkaline developing step of the processing.

Further according to the present invention an element is provided, wherein said topcoat layer of the non-light-sensitive backing layer comprises an ionic conducting polymeric compound as polystyrene sulfonic acid in an amount of from 20 up to 50 mg/m$^2$. In alkaline processing conditions even when the outermost layer containing said polystyrene sulfonic acid becomes completely removed as is normally the case, the objects of the present invention are fully attained, in that a sufficient scratch resistance is offered as desired.

Ionic conducting compounds, which may be also present in the layer under the topcoat backing layer, are high molecular weight polymeric compounds having ionic groups, e.g., besides the already mentioned polystyrene sulfonic acid, a polymeric compound having carboxylic sodium salt groups, built in at frequent intervals in the polymer chain [ref. Photographic Emulsion Chemistry, by G. F. Duffin,—The Focal Press—London and New York (1966)—Focal Press Ltd., p. 168]. In order to further enhance the permanence of the conductivity of ionic conductive polymers it is possible to cross-link these polymers with hydrophobic polymers as has been illustrated in U.S. Pat. Nos. 4,585,730; 4,701,403; 4,589,570; 5,045,441 and in EP-A's 0 391 402 and 0 420 226. The conductivity however of an antistatic layer containing said ionic conductive polymers, even after cross-linking, is dependent on moisture, quantitatively expressed as the relative humidity.

The topcoat layer of backing layer composition, which is removed in the alkaline developing step of the processing essentially comprises polymers having an acidic group or salts thereof as the polymeric carboxylic or sulphonic acids. Examples of such polymeric acids are polymers containing repeating units selected from the group consisting of acrylic acid, methacrylic acid, maleic acid, vinyl sulfonic acid and styrene sulfonic acid or mixtures thereof. Most preferred thereof, as already mentioned hereinbefore is polystyrene sulfonic acid and the sodium salt thereof, which is present in the layer between the subbing layer and the outermost layer of the back coating composition, preferably in an amount of from 20 up to 50 mg/m$^2$. This topcoat layer may comprise, besides lubricants, polymer beads, acting as spacing agents in order to reduce direct contact with adjacent surfaces.

Besides conductive (polymer) compounds providing the desired lateral electrical surface resistivity, ionic or non-ionic polymers or copolymeric combinations of monomers cited hereinbefore are optionally added to non-ionic surfactants having antistatic characteristics that is (are) present in the outermost layer at side of the support where the light-sensitive emulsion layer(s) has (have) been coated. As non-ionic surfactant(s) having antistatic characteristics any of the generally known polyalkylene oxide polymers are useful as antistatic agent. Suitable examples of alkylene oxides are e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides.

In one embodiment the outermost layer a gelatin free antistatic afterlayer covering said protective antistress layer and containing a conductive compound. The coating of the said gelatin free antistatic layer, as well as the coating of the antistress layer may proceed by any coating technique known in the art, e.g. by doctor blade coating, air knife coating, curtain coating, slide hopper coating or meniscus coating, which are coating techniques known from the production of photographic silver emulsion layer materials. Moreover the spray coating technique, known from U.S. Pat. No. 4,218,533, may be applied. Any thickening agent may be used in order to regulate the viscosity of the solution used for any of the said coating techniques provided that they do not particularly affect the photographic characteristics of the silver halide light-sensitive photographic material. Preferred thickening agents include aqueous polymers such as polystyrene sulphonic acid, sulphuric acid esters, polysaccharides, polymers having a sulphonic acid group, a carboxylic acid group or a phosphoric acid group, polyacrylamide, polymethacrylic acid or its salt, copolymers from acrylamide and methacrylic acid and salts derived thereof, copolymers from 2-acryl-amido-2-methyl-propansulphonic acid, polyvinyl alcohol, alginate, xanthane, carraghenan and the like. Polymeric thickeners well-known from the literature resulting in thickening of the coating solution may be used independently or in combination. Patents concerning thickening agents which can be used in the layers of the material acccording to the present invention are U.S. Pat. No. 3,167,410, Belgian Patent No. 558 143, JP-A's 53-18687 and 58-36768, DE-A 38 36 945 and EP-A's 0 644 456 and 0 813 105.

The gelatin-free antistatic afterlayer, if present as outermost layer of the material according to the present invention may further comprise spacing agents and coating aids such as wetting agents as e.g. perfluorinated surfactants. Spacing agents which may also be present in the protective antistress layer in generally have an average particle size which is comprised between 0.2 and 10 $\mu$m. Spacing agents can be soluble or insoluble in alkali.

Alkali-insoluble spacing agents usually remain permanently in the photographic element, whereas alkali-soluble spacing agents usually are removed therefrom in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708. Presence of at least one ionic or non-ionic polymer or copolymer latex in the protective antistress coating, and, optionally, in the afterlayer coated thereover, moreover provides the preservation of good antistatic properties of the material. Moreover the absence of water spot defects for the dry film after processing can be observed as has been described in EP-A's 0 644 454 and 0 644 456 as well as the appearance of an improved surface glare as has been described in the same EP-A's and in EP-A 0 806 705 and in EP-A 0 992 845, corresponding with U.S. Pat. No. 6,218,094. Even for thin coated layers for applications in rapid processing conditions the same advantages can be recognized. Furthermore the appearance of sludge in the processing is significantly reduced as well in hardener free as in hardener containing processing solutions.

Light-sensitive silver halide emulsions coated in one or more layers at one side of the subbed support may be composed of only one or a combination of more than one emulsion which means that the same or differing silver halide emulsions may be coated wherein differences are related with differences in silver halide composition (as e.g silver bromide, silver bromoiodide, silver chlorobromide, silver chlorobromoiodide, silver chloride, silver chloroiodide, silver chlorobromoiodide) and/or emulsion crystal habit (irregular or regular, being cubic, octahedral, intermediate forms thereof, {111} or {100} tabular, etc.), differences in mean crystal diameter, in monodispersity or heterodispersity of the emulsion distribution, differences in chemical sensitization (usually performed in the presence of compounds providing noble metals like gold and sulphur, selenium, tellurium or a combination thereof, whether or not in the presence of an oxidizing or a reducing agent and spectral sensitization (dyes spectrally sensitizing the emulsion crystals in the blue, green or red wavelength range or a combination thereof) as is well-known by anyone skilled in the art and as has extensively been described in Research Disclosure 38957, published Sep. 1, 1996.

The present invention will be illustrated hereinafter in the Examples hereinafter, without however being exhaustive therefore.

EXAMPLES

While the present invention will hereinafter be described in connection with preferred embodiments thereof, it will be understood that it is not intended to limit the invention to those embodiments.

Preparation of Materials Nos. 1 and 2

PEDT Containing Subbed Support

On a web made of clear base stretched polyethylene terephthalate having a thickness of approximately 610 $\mu$m was deposited, at both sides, following coating composition (given per liter of coating solution):

450 ml of demineralized water;

260 ml (30%, expressed as weight/volume unit) of a latex of ternary co-polymer being co(vinylidene chloride/methyl acrylate/itaconic acid) in a procentual weight ratio amount of 88/10/2;

91 ml (30%, expressed as weight/volume unit) of a latex of ternary co-polymer being co(butadiene/methyl acrylate/itaconic acid) in a procentual weight ratio amount of 47.5/47.5/5;

5 ml of concentrated ammonium hydroxide;

5.8 ml of an aqueous solution (50%, expressed as weight/volume unit) of melamine-formaldehyde derivative "Parez Resin 707"

5 ml of Kieselsol 100 ™, trademark product from Bayer A G, Leverkusen, Germany.

190 ml of a solution containing per liter of said solution
- 600 ml of demineralized water;
- 7.44 g of NaOH;
- 47.2 g of sulfosalicylic acid sodium salt;
- 260 ml ethanol
- 4.4 g of HOSPITAL BV
- 40 g of floroglucin
- 7.76 g of AKYPO OP 80
- 32.8 g of sorbitol
- 40.8 g of 1,2-propanediol Said coating composition was applied by air-knife coating at a coverage of 130 sq.m./liter, on the side of said support, where the emulsion layers were coated afterwards.

The layer was dried in hot air stream whereafter the film was stretched transversally to 3.5 times its original width in a tenter frame in order to get a final film thickness of about 175 $\mu$m.

The film was then heat-set while being kept under tension at a temperature of 190° C. for about 20 seconds.

After heat-setting the film coated with this subbing layer at one side thereof was cooled and further coated with the compositions A and B as a first layer in contact with the subbed support layer for the Materials 1 and 2 respectively, and composition C as a second layer for the Materials 1 and 2.

Composition A 500 ml of said coating composition A are containing:

447.5 ml of demineralized water;

5.8 ml of latex B (addition copolymer of vinylidene chloride, methylacrylate and itaconic acid, containing 88% by weight of vinylidene chloride units, 10% by weight of methylacrylate units, and 2% by weight of itaconic acid units was prepared as a latex by classical emulsion polymerization conducted in aqueous medium in the presence of persulphate as initiator; concentration expressed as weight per volume unit: 30%).

43.8 ml of a dispersion of poly(3,4-ethylenedioxy-thiophene)/polyanion prepared before as follows:

Into 1000 ml of an aqueous solution of 20 g of polystyrene sulfonic acid (109 mmol of $SO_3H$ groups) with number-average molecular weight (Mn) 40,000, were introduced 12.9 g of potassium peroxidisulfate ($K_2S_2O_8$), 0.1 g of $Fe_2(SO_4)_3$ and 2.8 g of 3,4-ethylenedioxy-thiophene. The thus obtained reaction mixture was stirred for 24 h at 20° C. and subjected to desalting. 500 ml of the above prepared reaction mixture were diluted with 500 ml of water and stirred for 6 hours at room temperature in the presence of a granulated weak basic ion exchange resin LEWATIT H 600 (tradename of Bayer A G) and strongly acidic ion exchanger LEWATIT S 100 (tradename of Bayer A G. After said treatment the ion exchange resins were filtered off and the potassium ion and sulfate ion content were measured which were respectively 0.4 g $K^+$and 0.1 g $(SO_4)^{2-}$ per liter.

1.25 ml of N-methylpyrrolidone;

1.7 ml UVON (=10% solution, expressed as weight per volume unit, of ULTRAVON W in a solution of demineralized water/ethanol 80/20).

Coating composition A was coated at one side of the subbed support described hereinbefore in an amount in order to coat 35 sq.m./liter as a first layer of Material 1 coated upon the subbed support described hereinbefore.

Drying was performed during 1 minute at 120° C.

Composition B 500 ml of said coating composition B are containing:

482 ml of demineralized water;

5.8 ml of latex B (same as in composition A, given hereinbefore)

8.75 ml of a dispersion of poly(3,4-ethylenedioxy-thiophene)/polyanion prepared as given hereinbefore (composition A)

1.25 ml of N-methylpyrrolidone;

1.7 ml UVON (=10% solution, expressed as weight per volume unit, of ULTRAVON W in a solution of demineralized water/ethanol 80/20).

Coating composition B was coated at one side of the subbed support described hereinbefore in an amount in order to coat 35 sq.m./liter as first layer of Material 2 coated upon the subbed support described hereinbefore.

Drying was performed during 1 minute at 120° C.

A color print (color positive) materials was coated as described in EP-A 0 252 550 and in the corresponding U.S. Pat. No. 4,770,984.

A further difference between comparative material No. 1 and inventive material No. 2 was the presence, in the outermost backing layer, of carnauba wax as a lubricant in an amount of 5 mg/m$^2$ and presence in the yellow antihalation undercoat of CETIOL S (trademark product from HENKEL) as a high temperature boiling solvent in an amount of 0.2 mg/m$^2$, the chemical structure of which has been given hereinbefore as compound (VII). Both materials were coated with an outermost backing layer comprising acid as an antistatic agent: polystyrene sulfonic acid in an amount of 35 mg/m$^2$; as a binder: a sodium salt latex copolymer of vinyl acetate/maleic acid in an amount of 20 mg/m$^2$; and as a lubricant polyethylene wax in an amount of 12.5 mg/m$^2$.

Evaluation of the Material Samples Nos. 1 and 2.

The resistance of the best conducting layer, the so-called "Q-mobile" value, was determined at 30% of relative humidity ("R.H.") at room temperature (21° C.), said value being practically independent upon relative humidity, and was expressed in Ohm/square. The corresponding value was determined at the side of the support where the light-sensitive emulsion layers were coated.

A layer arrangement was performed, just as in U.S. Pat. No. 4,770,984 wherein, in the Example, Element C had no carbon black antihalation back layer, but instead had a yellow antihalation undercoat between the subbed support and the blue-sensitive emulsion layer, the yellow antihalation undercoat having a thickness of 1 $\mu$m and comprising 250 mg of the yellow dye YM-03 from that U.S. Pat. No. and 1.0 g of gelatin per m$^2$ and in addition thereto comprised in the intermediate gelatin layer between the blue-sensitive emulsion layer and the red-sensitized emulsion layer the blue dye B-01 in an amount of 50 mg per m$^2$, the amount of gelatin being 0.84 g per m$^2$.

Following test procedure, described in Research Disclosure—June 1992, item 33840—was therefore applied in order to capacitively measure the resistance of the best conducting layer (layer having the lowest resistance) in a layer arrangement of a multilayered material: the resistance of the layer assemblage was measured contactless by arranging it between capacitor plates making part of a RC-circuit differentiator network as described.

TABLE 1

"Q-mobile" resistance of the antistatic layer showing the best conductivity (lowest resistance), before and after color processing, at the light-sensitive side of the color print materials having a covered subbing layer containing PEDT.

| Matl. No. | Q-mobile Ohm/square 30% R.H. | Before processing | After processing |
|---|---|---|---|
| 1 (comp.) | | $3.0 \times 10^{12}$ | $>10^{14}$ |
| 2 (inv.) | | $3.0 \times 10^{8}$ | $1.0 \times 10^{9}$ |

As becomes clear from Table 1 superior antistatic properties of the Material No. 2 according to the present invention are due to in the antistatic layer having the best conductivity (lowest resistance) being the subbing layer, comprising an antistatic agent providing a substantially unchanged electrical resistivity of the said element before and after processing it (substantially unchanged as the changes are limited within a factor of 3.3, being less than the preferred factor of less than 10 as set forth hereinbefore.

Moreover static and dynamic frictional coefficients of backing layers of the material were determined by following procedure.

The static and dynamic frictional coefficients between two materials were determined by fastening a 35 mm×274 mm strip with the first material uppermost, placing a 35 mm×274 mm strip with the second material in contact with the uppermost layer of the first strip, attaching the end of the second strip to a calibrated strain gauge either directly as in the case of dynamic measurements or via a spring (spring constant 0.2N/m) as in the case of static measurements, placing a 117 g hard rubber roller on the second strip, setting the strain gauge in motion at a constant speed of 15 cm/minute in a horizontal direction over a displacement of 13 cm and recording the voltage output from the strain gauge. The voltages are converted into pulling forces using a calibration plot obtained using standard weights and the frictional coefficient $\mu$ calculated using the expression: pulling force, $F_G$/load,N.

In the case of the determination of a dynamic frictional coefficient, $\mu_{dynamic}$, $F_G$ does not fluctuate much and an average value for $F_G$ is taken to calculate the $\mu_{dynamic}$ value given in the inventive and comparative material. However, in the case of static frictional coefficient measurements $F_G$ steadily increases to a maximum value as the spring takes up the strain until movement occurs, whereupon $F_G$ decreases only to rise again to this maximum value when the movement stops and so on. It is this maximum value of $F_G$ which is used in the calculation of the $\mu_{static}$ given in the inventive and comparative material.

The values given for the inventive and comparative material are the average values of four measurements with different strips carried out at 21° C. and 50% relative humidity, the strips being conditioned in this atmosphere for at least 4 hours before the measurements are carried out.

In the Table 2 static and dynamic frictional coefficients have been given for the Materials Nos. 1 and 2 wherein contact was made between and the backing layer (BL) and the light-sensitive (emulsion) side giving a first figure in the Table 2, and between the backing layer (BL) and stainless steel (SS) as a second figure.

On the backing layer side a friction coefficient of the backing layer versus stainless steel remains unchanged in the range between 0.20 and 0.30 before and after processing of said material, even after removal of the said topcoat layer during processing.

TABLE 2

Static frictional coefficients of their backing layer sides of the color print materials versus the light-sensitive (emulsion side) of the same materials (BL) and stainless steel (SS) respectively.

| Matl. No. | Before processing (BL) | After processing (BL) | Before processing (SS) | After processing (SS) |
|---|---|---|---|---|
| 1 (comp.) | 0.23 | 0.38 | 0.26 | 0.37 |
| 2 (inv.) | 0.23 | 0.27 | 0.21 | 0.29 |

The Table 2 hereinbefore and 3 hereinafter are both illustrative for the lower and less variable (compared before and after processing) static and dynamic frictional coefficients of the backing layer of the inventive material containing carnauba wax.

TABLE 3

Dynamic frictional coefficients of their backing layer sides of the color print materials versus the light-sensitive (emulsion side) of the same materials (BL) and stainless steel (SS) respectively.

| Matl. No. | Before processing (BL) | After processing (BL) | Before processing (SS) | After processing (SS) |
|---|---|---|---|---|
| 1 (comp.) | 0.23 | 0.31 | 0.21 | 0.26 |
| 2 (inv.) | 0.22 | 0.23 | 0.19 | 0.23 |

Subtitling Experiment of Processed Materials

In another experiment the materials Nos. 1 and 2 were exposed and color processed and the color print film was subtitled by means of a laser having a power of 6 W, 5 W and 4 W as described in EP-A 0 782 045 and the corresponding U.S. Pat. No. 5,981,155.

The color motion picture film as well as still film pictures made therefrom were projected and evaluated visually (qualitatively) on a projection screen. For all examined film samples the results became better after inscription with the laser having a decreasing power (4 W better than 5 W; 5 W better than 6 W). Differences between materials Nos. 1 and 2 however were clearly showing a character type with less noise for the inventive material No. 2, if compared with the comparative material No. 1, as became clear for any laser power.

It is clear from the example that the objects of the present invention have been fully attained by providing a photographic film material useful as a motion picture print film, without utilizing a backing layer containing "carbon black", which does not show the aforesaid problems of loss of conductivity and loss of durability, especially with respect to scratching stability, as became clear from the lower friction coefficients as measured; moreover showing after exposure and processing better laser subtitling properties.

The measurement as described in Research Disclosure June 1992, item 33840 is reproduced herein.

The measuring cell consists of two nearly identical halves, between which the test sample can be placed after lifting the upper half. By closing the measuring cell, sample is pressed between the earthed contact plates. In the center of both contact plates a circular opening is left, so that both sides of the sample on this area are feely exposed to the air. Round electrodes (5 mm in diameter) are mounted in the center of these openings on both sides of the layer to be measured, at a short distance (approx. 0.3 mm) from and parallel to the sample surface. Through the upper electrode the generator voltage is supplied by means of a shielded conductor, through the lower electrode the signal is capacitively branched off and transmitted to a preamplifier. The electrodes are fitted within ring-like supporting lips made of PTFE surrounding the electrodes at a short distance, ensuring a proper vertical position of the layer with respect to the electrodes.

Said lips reach up to the sample and are particularly useful for samples showing heavy curl and for samples having a width smaller than 30 mm, i.e. the diameter of the openings in the contact plates.

For an optimum approach to the theoretical diagram the earth-leakage capacitance of the sample was kept at a minimum, when designing the measuring cell. To this end the edges of the openings in the contact plates were beveled and an insulating material with minimum dielectric constant was selected for the manufacture of the supporting lips.

As a result of the choice of preamplifier (electrometer type) the effect on the serial circuit through the measuring electrode can be disregarded. The layer can be considered as actually grounded due to the substantial capacitance between sample and contact plates.

The measuring cell is suited to all sample sizes of over 40 mm in diameter and up to max. 0.5 mm in thickness. For samples of smaller widths, e.g. 35 or 16 mm, a mm. length of 100 mm is required.

As the use of alternating voltage according to the present measuring method enables the definition of the mobility of the charges (symbol Q) in the layer, the present method is called "Q-mobile". A PC is connected to a function generator and an oscilloscope. The optimal signal/noise ratio is obtained by amplification of the generator signal before its input to the measuring cell. The branched off measuring signal is inputted to the oscilloscope after proper amplification. The softwared of the PC ensures further processing and evaluation of the measuring signal, correction of minor deviations from the theoretical curve, generator control and reporting.

What is claimed is:

1. A silver halide photographic film element comprising:

on a light-sensitive side of a transparent polyester support, in order, an electrically conductive subbing layer, an antihalation undercoat, a light-sensitive emulsion layer or layer arrangement and a protective overcoat, on a non-light-sensitive backing layer at the side opposite thereto, in order, a subbing layer containing a lubricant and a topcoat layer, characterized in that on the light-sensitive side said subbing layer, comprises an antistatic agent providing a substantially unchanged electrical resistivity of the said element before and after processing it, whereas on the backing layer side a friction coefficient of the backing layer versus stainless steel remains unchanged in the range between 0.20 and 0.30 before and after processing of said material.

2. An element according to claim 1, wherein in the subbing layer at the light-sensitive side, the said antistatic agent providing an unchanged electrical resistivity of this subbing layer before and after processing of said material, is a polythiophene compound, in corporated in said subbing layer(s).

3. Element according to claim 1, wherein in the subbing layer at the light-sensitive side, the said antistatic agent providing an unchanged electrical resistivity of this subbing layer before and after processing of said material, is a metal oxide compound, said metal being selected from the group consisting of tin, indium tin, vanadium, zinc, manganese, titan, indium, silicium, magnesium, barium, molybdene and tungsten.

4. Element according to claim 1, wherein said electrical resistivity is between $1\times10^5$ and $1\times10^{12}$ Ω/□, measured as described in Research Disclosure June 1992, item 33840 for said subbing layer, as layer having the lowest resistance.

5. Element according to claim 1, wherein said electrical resistivity at the emulsion side of the element or material between $1\times10^7$ and $1\times10^{10}$ Ω/□.

6. An element according to claim 1, wherein said antihalation undercoat comprises one or more dye(s), at least one yellow non-diffusing dye that absorbs blue light and is removable and/or decolorizable in a processing bath, and is chosen from the group consisting of merostyryl dyes and monomethine oxonol dyes.

7. An element according to claim 6, wherein said antihalation undercoat comprises a high temperature boiling solvent.

8. An element according to claim 7, wherein said high temperature boiling solvent is present in a total amount of from 0.1 $g/m^2$ up to not more than 0.5 $g/m^2$.

9. An element according to claim 1, wherein said lubricant is present in at least the subbing layer of the non-light-sensitive backing layer and wherein said lubricant is a compound selected from the group consisting of carnaubawax, montanwax, polyethylene, a fluorinated polymer, a silicon polymer, higher alcohol esters of fatty acids, higher fatty acid calcium salts, metal stearates, water dispersible siloxane-containing polyurethane formed from prepolymer containing anionic and non-anionic hydrophilic groups, and paraffins.

10. An element according to claim 1, wherein said topcoat layer of the non-light-sensitive backing layer comprises polystyrene sulfonic acid in an amount of from 20 up to 50 $mg/m^2$.

* * * * *